United States Patent [19]

Sroub

[11] 4,264,102

[45] Apr. 28, 1981

[54] CHAISE LOUNGE

[75] Inventor: Joseph W. Sroub, Parma, Ohio

[73] Assignee: Cardinal American Corporation, Cleveland, Ohio

[21] Appl. No.: 1,289

[22] Filed: Jan. 5, 1979

[51] Int. Cl.[3] ..... A47C 1/024

[52] U.S. Cl. ..... 297/377; 297/21

[58] Field of Search ..... 297/377, 354, 355, 19, 297/21, 22, 29

[56] References Cited

U.S. PATENT DOCUMENTS

| | | | |
|---|---|---|---|
| 1,002,305 | 9/1911 | Pattinson | 297/19 |
| 2,282,270 | 5/1942 | Vallone | 297/377 X |
| 2,614,612 | 10/1952 | Wogomon | 297/377 X |
| 2,626,653 | 1/1953 | Van Wyck | 297/19 |
| 2,696,869 | 12/1954 | Schlaak | 297/22 |
| 2,710,050 | 6/1955 | Du Bois | 297/377 |
| 3,211,495 | 10/1965 | Nielsen | 297/377 X |
| 4,084,849 | 4/1978 | Ishida et al. | 297/377 X |

FOREIGN PATENT DOCUMENTS

| | | | |
|---|---|---|---|
| 384735 | 12/1932 | United Kingdom | 297/22 |

*Primary Examiner*—William E. Lyddane

[57] ABSTRACT

A chaise lounge is disclosed of lightweight durable construction, consisting of a minimum number of parts of readily available materials, which can be assembled without the aid of tools other than conventional ones. The parts can be packaged in a relatively small space for shipping purposes. The chaise lounge has incorporated therein novel or unique means for adjusting the inclination of the back thereof.

4 Claims, 11 Drawing Figures

CHAISE LOUNGE

This invention relates, as indicated, to chaise lounges, but is directed more particularly to a chaise lounge designed for rugged outdoor use.

A primary object of the invention is to provide a chaise lounge of the character described, which is durable, comfortable and of lightweight construction.

Another object of the invention is to provide a chaise lounge of the character described, which consists of a minimum number of parts, which can be packaged in a relatively small space or container for shipping purposes, and can be quickly and easily assembled by unskilled persons without the aid of tools, other than conventional or easily available tools, such as a screw driver or small wrench.

A further object of the invention is to provide a chaise lounge of the character described, which embodies in its construction tubular members of simple, easily manufactured design and wooden members made of readily available sizes of lumber.

A still further object of the invention is to provide a chaise lounge of the character described, having novel or unique means for adjusting the inclination of the back of the lounge.

Other objects and advantages of my invention will be apparent in the course of the following description.

In the accompanying drawings, forming a part of this specification, and in which like numerals are employed to designate like parts throughout the same, FIG. 1 is a perspective view of the chaise lounge;

Figure 1:
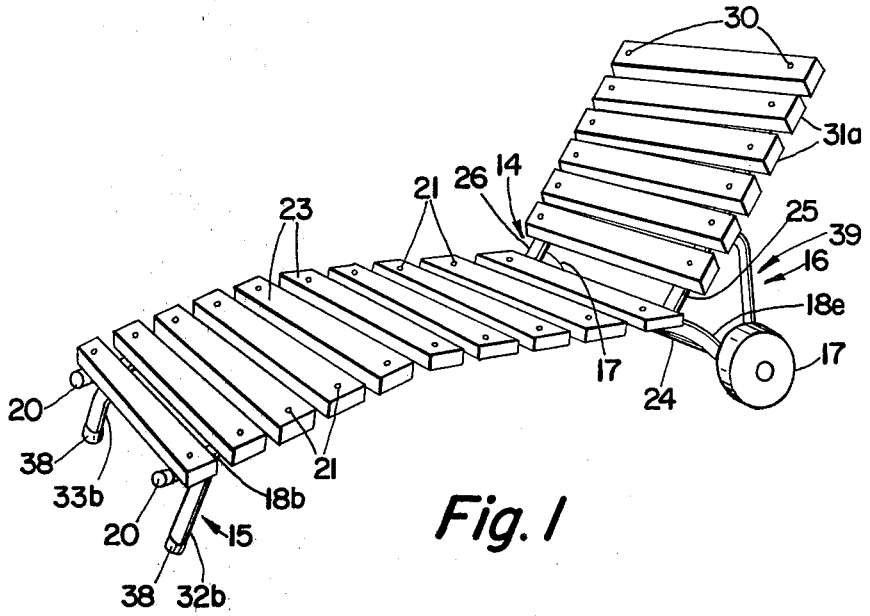

Referring more particularly to the drawings, the chaise lounge will be seen to comprise a seat frame, generally designated by reference numeral 13, a back, generally designated by reference numeral 14, a front support, generally designated by reference numeral 15, a back brace, generally designated by reference numeral 16 and rear support wheels 17.

The seat frame 13 of the chaise lounge consists of a pair of transversely-spaced tubes 18 and 19, made of 16 gauge, 1½" diameter, welded steel tubing.

The tube 18 is bent, as at **18*a*, to provide a downwardly inclined forward portion 18*b* and a downwardly inclined rearward portion 18*c*, and is bent as at 18*d*, to provide a downwardly inclined leg portion 18*e***.

The tube 19 is similarly bent as at **19*a*, to provide a downwardly inclined forward portion 19*b* and a downwardly inclined rearwardly portion 19*c*, and is bent as at 19*d*, to provide a downwardly inclined leg portion 19*e***.

The tubes 18 and 19 are provided at their forward open ends with protective caps 20.

Figure 7:
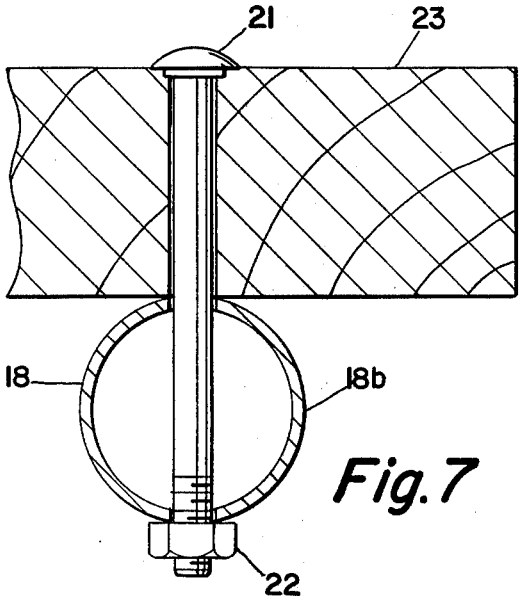
FIG. 7 is a fragmentary cross-sectional view taken on the line 7—7 of FIG. 2.

Secured to the portions **18*b*, 18*c*, and 19*b*, 19*c* of the tubes 18 and 19 at uniformly spaced points, as by carriage bolts 21 and nuts 22 (see FIG. 7), are wooden slats 23**, which may be made of 2"×4" or 1"×4" lumber.

The rear ends of the leg portions **18*e* and 19*e* of the tubes 18 and 19 are pivotally secured to an axle 24 on which the rear support wheels 17** are mounted.

Figure 8:
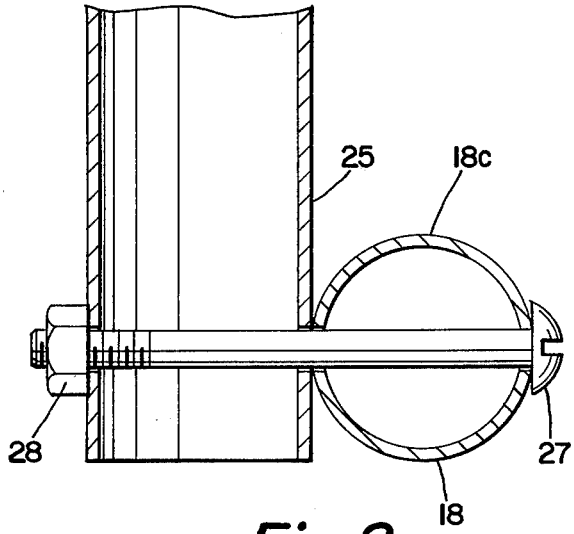
FIG. 8 is a fragmentary cross-sectional view taken on the line 8—8 of FIG. 2.
Figure 9:
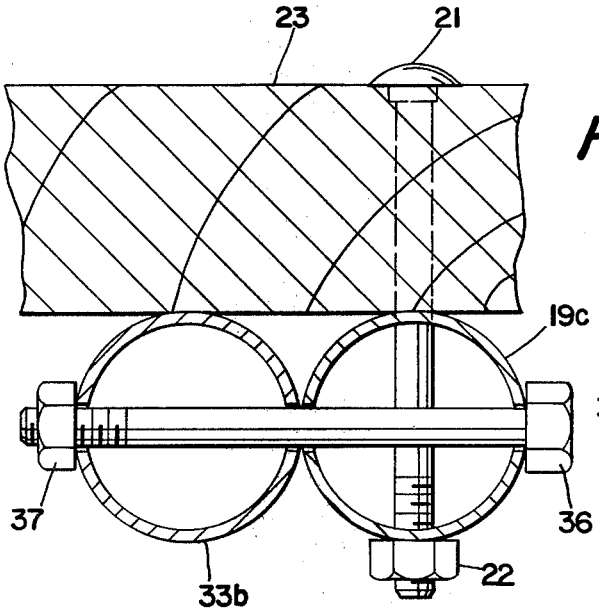
FIG. 9 is a fragmentary cross-sectional view taken on the line 9—9 of FIG. 4.

The back 14 of the chaise lounge consists of a pair of transversely-spaced straight tubes 25 and 26 made of 16 gauge, 1½" diameter, welded steel tubing and which, as best seen in FIG. 8, are pivotally secured to the tubes 18 and 19, as by screw bolts 27 and nuts 28.

The tubes 25 and 26 are provided at their upper ends with protective caps 29.

Figure 11:
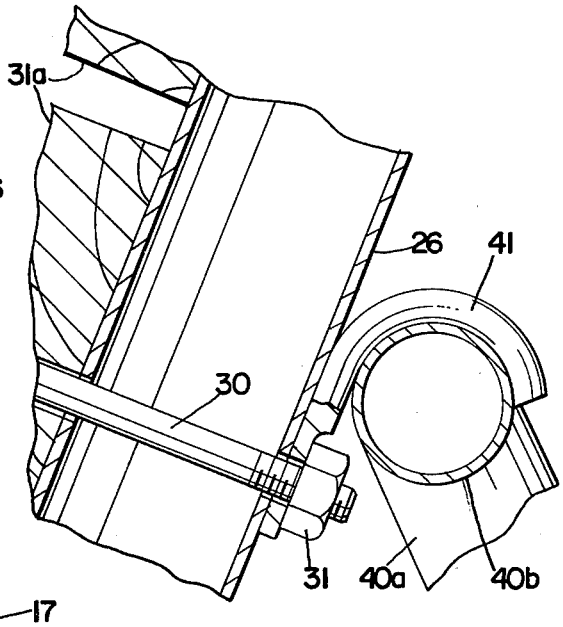
FIG. 11 is a fragmentary cross-sectional view taken on the line 11—11 of FIG. 6.

Secured to the tubes 25 and 26 at uniformly spaced intervals, as by carriage bolts 30 and nuts 31 (see FIG. 11), are wooden slats **31*a***, which may be made of 2"×4" or 1"×4" lumber.

The front support 15 of the chaise lounge consists of a pair of transversely-spaced tubes 32 and 33, made of 16 gauge, 1½" diameter, welded steel tubing.

The tube 32 is bent as at **32*a*, to provide a forwardly and downwardly extending leg portion 32*b*, and a rearwardly extending portion 32*c*, which as best seen in FIGS. 2, 3, 4 and 9, extends parallel with the portion 18*b* of the tube 18 and is secured to the latter by means of bolts 34 and nuts 35**.

Figure 2:
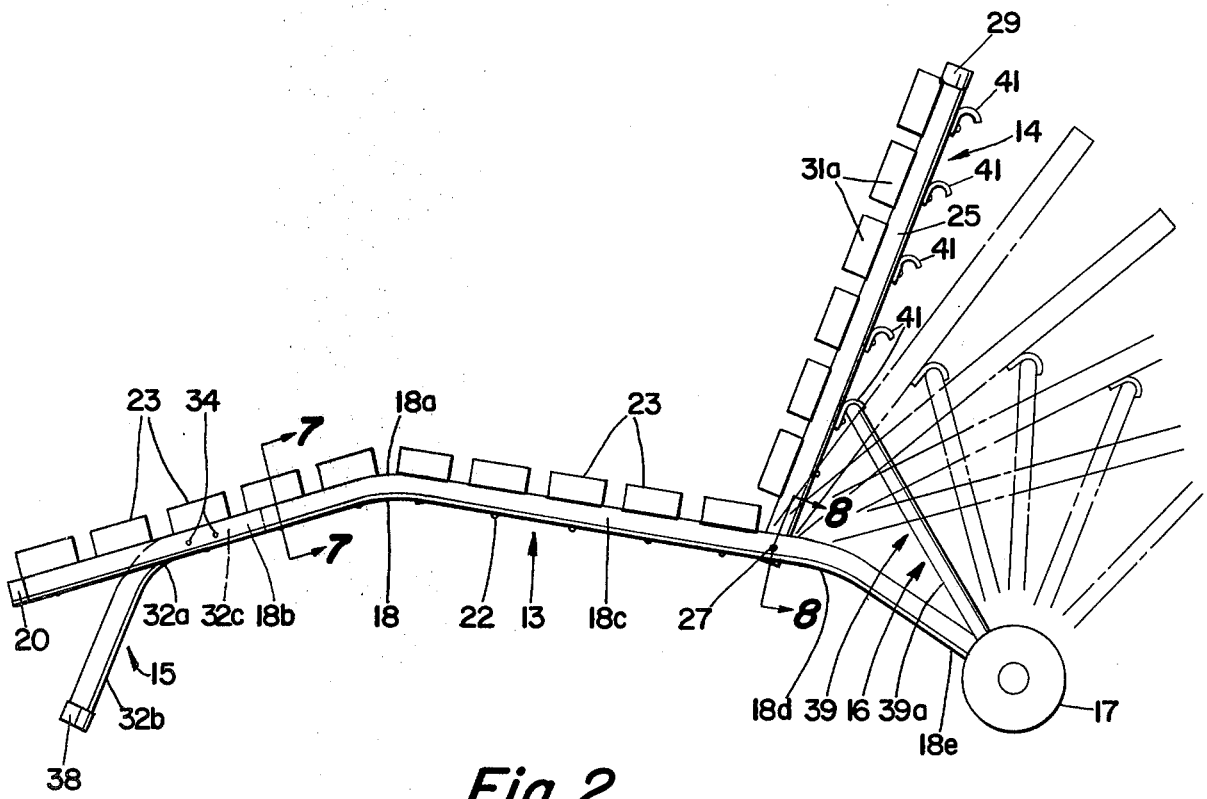
FIG. 2 is a side elevational view of the chaise lounge, showing, in somewhat diagrammatic manner, the various inclinations to which the back of the chaise lounge may be adjusted.
Figure 3:
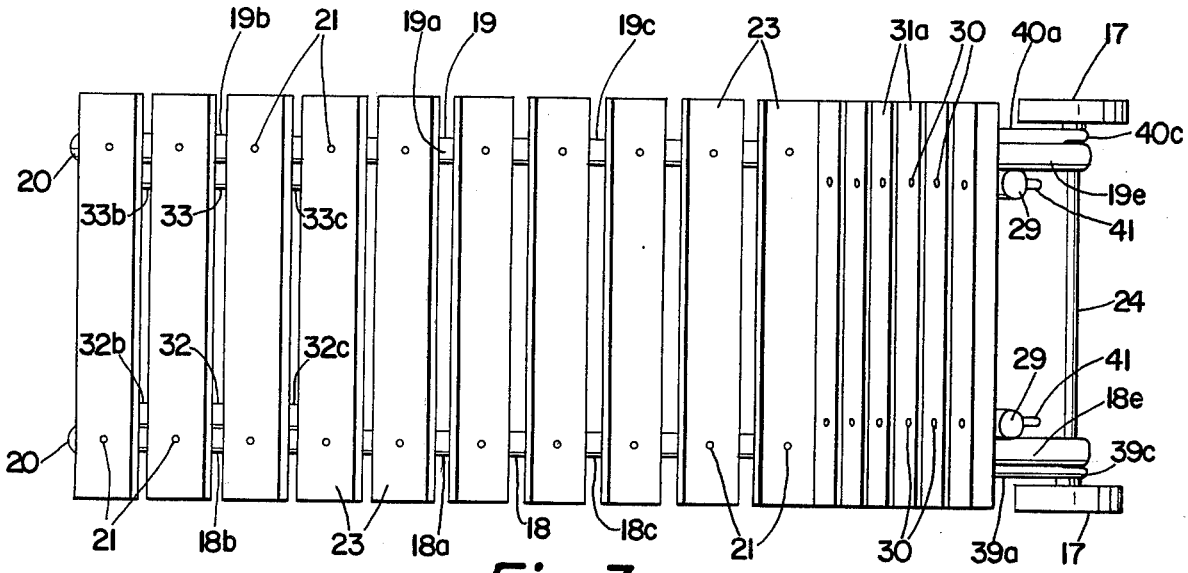
FIG. 3 is a top plan view of the chaise lounge.
Figure 4:
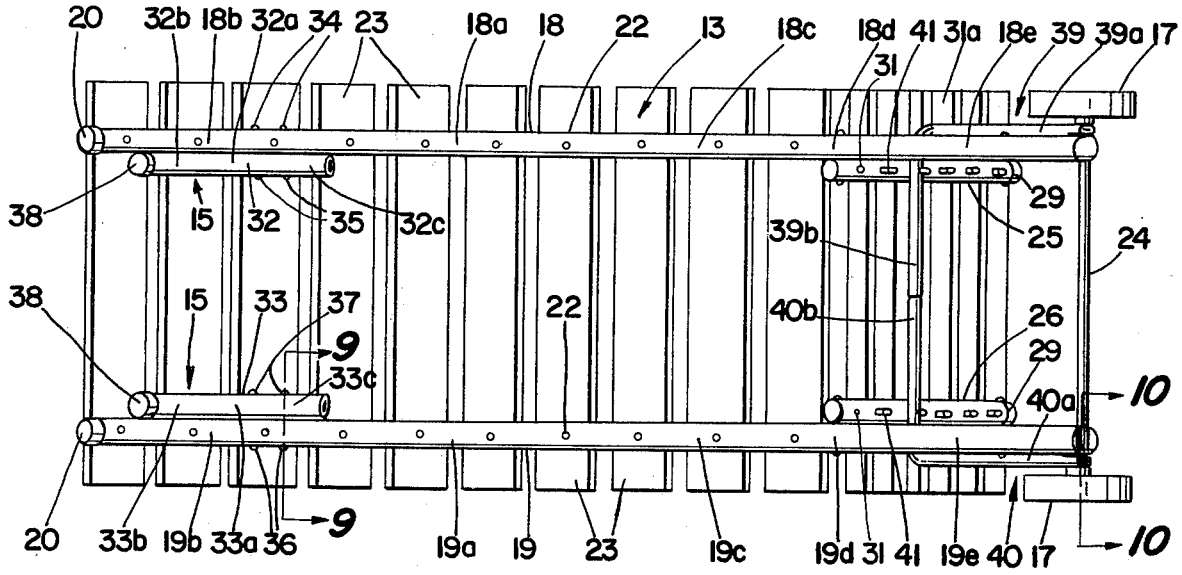
FIG. 4 is a bottom plan view of the chaise lounge.
Figure 5:
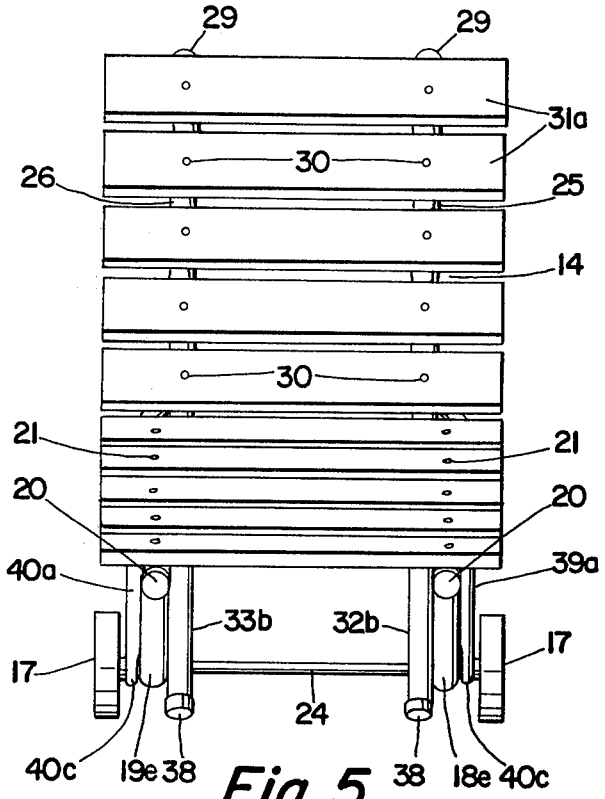
FIG. 5 is a front elevational view of the chaise lounge.

The tube 33 is similarly bent as at **33*a*, to provide a forwardly and downwardly extending leg portion 33*b*, and a rearwardly extending portion 33*c*, which as best seen in FIGS. 2, 3 and 4, extends parallel with the portion 19*b* of the tube 19, and is secured to the latter by means of bolts 36 and nuts 37**.

The leg portions **32*b* and 33*b* of the tubes 32 and 33 are provided at their lower ends with protective caps 38**.

The back brace 16 of the chaise lounge consists of two L-shaped tubular members 39 and 40, made of 16 gauge, 1" diameter, welded steel tubing.

The member 39 comprises a portion **39*a*, which lies in a plane parallel with the axis of the tube 25, and a portion 39*b*, which extends transversely to the portion 39*a*. The lower end of the portion 39*a* is flattened as at 39*c*, and is pivotally secured to the axle 24, at a position between the portion 18*e* of the tube 18 and the adjacent wheel 17**.

Figure 10:
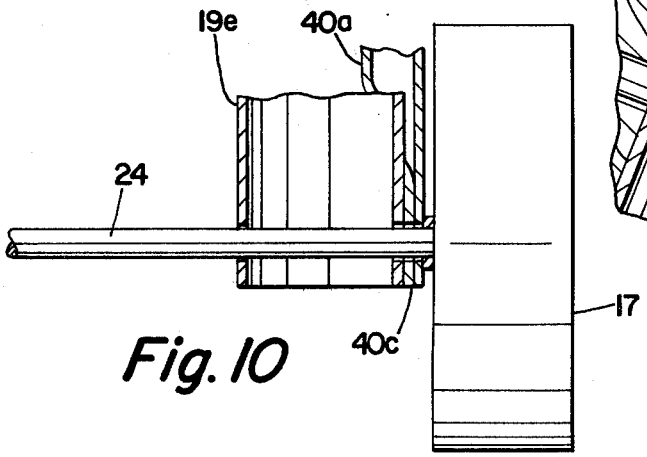
FIG. 10 is a fragmentary cross-sectional view taken on the line 10—10 of FIG. 4.

The member 40 comprises a portion **40*a*, which lies in a plane parallel with the axis of the tube 26, and a portion 40*b*, which extends transversely to the portion 40*a*. The lower end of the portion 40*a* is flattened, as at 40*c*, and is pivotally secured to the axle 24, at a position between the portion 19*e* of the tube 19 and the wheel 17, as best seen in FIG. 10**.

Figure 6:
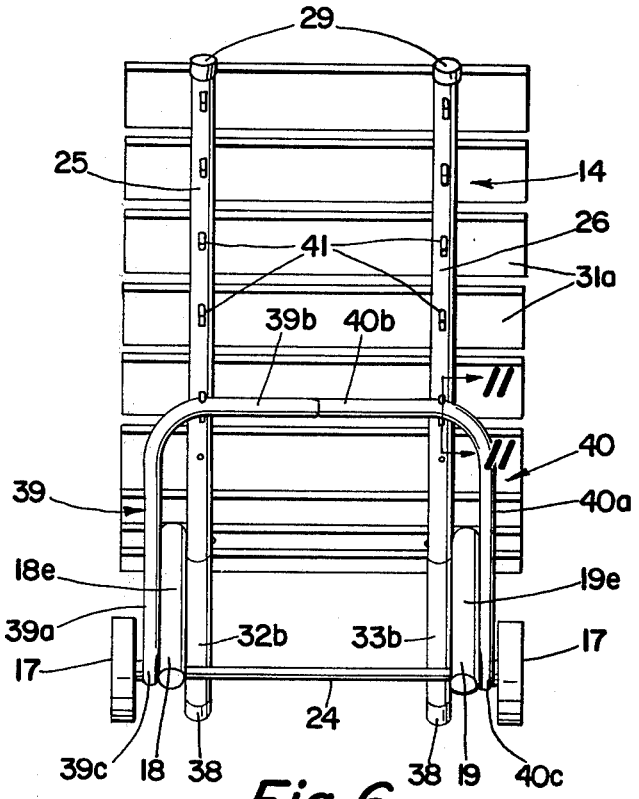
FIG. 6 is a rear elevational view of the chaise lounge.

For the purpose of assembling the members 39 and 40 to form the brace 16, the inboard end of the portion **40*b* of the member 40 is swaged to have a slip or slide fit in the inboard end of the portion 39*b* of the member 39, as best seen in FIG. 6**.

The brace 16 is designed to support the back 14 of the chaise lounge, in a plurality of selected inclined positions, as indicated in FIG. 2 of the drawings.

For this purpose, the tubes 25 and 26, as best shown in FIGS. 2, 4, 6 and 11 are provided at points spaced longitudinally thereof with hooks 41, which extend rearwardly of the back 14 of the chaise lounge, and are secured to the tubes 25 and 26 by means of the same bolts 30 and nuts 31 which secure the slats 31*a* to the tubes 25 and 26.

In FIG. 2, the brace 16 is shown, in solid lines, as coacting with the lowest of the hooks 41 to maintain the back 14 of the chaise lounge in its highest position.

The pressure or weight of the occupant's back is sufficient to cause the hooks 41 to retain the brace 16 in such position.

When is it desired to change or adjust the inclination of the back to any one of the other positions shown in broken lines in FIG. 2, the back 14 is moved forwardly about the bolts 27 to thereby disengage the hook 41 from the brace 16, after which the back 14 is lowered to the adjusted positions, to bring other hooks into engagement with the brace.

It is thus seen that I have provided a chaise lounge which fulfills all of the stated objects of the invention, and at the same time, is handsome and attractive in appearance.

It is to be understood that the form of my invention, herewith shown and described, is to be taken as a preferred example of the same, and that various changes may be made in the shape, size and arrangement of parts thereof, without departing from the spirit of the invention or the scope of the subjoined claims.

Having thus described my invention, I claim:

1. In a chaise lounge of the character described, a seat frame comprising a pair of transversely-spaced tubular seat members, each bent to provide a downwardly inclined forward portion, a downwardly inclined intermediate portion, and a downwardly inclined leg portion disposed rearwardly of said intermediate portion, tubular front legs removably secured to said downwardly inclined forward portions of said members and having downwardly extending floor engaging portions, rear support wheels disposed adjacent the rear ends of said downwardly inclined leg portions, an axle interconnecting said support wheels, said leg portions being pivotally secured to said axle, a back comprising a pair of transversely-spaced straight tubular members secured to said tubular seat members and adapted to be adjusted to a plurality of inclined positions relatively to said seat members, and means for supporting said back in a plurality of inclined positions, said means comprising an inverted U-shaped frame pivotally connected to said axle, said straight tubular members being provided with longitudinally-spaced hooks adapted to be engaged by said U-shaped frame.

2. A chaise lounge, as defined in claim 1, including longitudinally-spaced, transversely-extending slats supported by and secured to said downwardly inclined forward portion and downwardly inclined intermediate portion of said seat frame, and said back.

3. A chaise lounge, as defined in claim 2, wherein said hooks are secured to said straight tubular members by the same means which secures said slats to said straight tubular members.

4. In a chaise lounge of the character described, a seat frame comprising a pair of transversely-spaced tubular seat members, each having a downwardly inclined rear leg portion, rear support wheels disposed adjacent the rear ends of said leg portions, an axle interconnecting said support wheels, said leg portions being pivotally secured to said axle, a back pivotally secured to said tubular seat members, and means for supporting said back in a plurality of inclined positions, said means comprising an inverted U-shaped frame, the arms of which extend angularly to said back and are pivotally secured to said axle.

* * * * *